United States Patent [19]

Vallance

[11] 4,275,375

[45] Jun. 23, 1981

[54] HEATING ELEMENT CONNECTOR AND METHOD

[75] Inventor: Charles B. Vallance, Berrien Springs, Mich.

[73] Assignee: Leco Corporation, St. Joseph, Mich.

[21] Appl. No.: 6,596

[22] Filed: Jan. 26, 1979

[51] Int. Cl.[3] ..... H01C 1/148; H01C 1/144

[52] U.S. Cl. ..... 338/329; 29/621; 174/84 C; 174/94 R; 219/541; 228/122; 338/332

[58] Field of Search ..... 228/122, 179, 175, 206-207; 338/316, 332, 329; 219/267, 270, 541; 174/84 C; 339/275 R, 275 T; 29/621, 628

[56] References Cited

U.S. PATENT DOCUMENTS

| | | | |
|---|---|---|---|
| 1,418,633 | 6/1922 | Egly | 29/621 |
| 1,743,615 | 1/1930 | Nead et al. | 228/206 |
| 2,708,701 | 5/1955 | Viola | 338/332 X |
| 3,522,574 | 8/1970 | Giler | 338/316 |
| 3,813,643 | 5/1974 | Hartz | 338/332 X |
| 3,842,497 | 10/1974 | Kehl et al. | 29/628 |
| 3,969,696 | 7/1976 | Wolfe et al. | 338/332 X |

*Primary Examiner*—Gil Weidenfeld
*Assistant Examiner*—Kenneth J. Ramsey
*Attorney, Agent, or Firm*—Price, Heneveld, Huizenga & Cooper

[57] ABSTRACT

A copper sleeve is employed to join a molybdenum disilicide heating rod with a conductor by a brazing process including fluxing the interior of the sleeve, positioning the sleeve partially over one end of the heating rod and heating the junction of the sleeve and rod in a nonoxidizing flame while applying a brazing alloy to the interior of the sleeve. The conductor is then crimped to the opposite end of the sleeve for providing an electrical and mechanical connection of the conductor to the heating rod.

9 Claims, 3 Drawing Figures

HEATING ELEMENT CONNECTOR AND METHOD

BACKGROUND OF THE INVENTION

The present invention relates to a method and apparatus for attachment of a conductor to a cermet heating element.

In combustion systems used for combusting a specimen for subsequent analysis of the type disclosed in copending U.S. patent application entitled COMBUSTION SYSTEM, filed on Nov. 9, 1978, Ser. No. 958,967, and assigned to the present assignee, cermet heating elements are employed in the resistance heating furnace. One type of resistance heating element is made of molybdenum disilicide and is commercially available and sold under the trademark KANTHAL®. These elements provide the relatively high temperatures necessary and desirable in combustion systems for specimen combustion for subsequent analysis.

The KANTHAL® heating elements typically are provided from the manufacturer with ends for receiving clamp-on connectors. The ends are aluminum coated to provide an electrical connection to the heating elements with a standard clamp-type connector. It has been found that such connections, although initially operating satsifactorily, have a marked tendency to oxidize due in part to the exposure to high temperatures in the furnace environment resulting in arcing at the junction of the conductors which supply the operating current and the heating element. The oxidizing naturally results in reduction in the current supplied to the heating element and further breakdown of the connection and prevents the furnace from reaching its desired operating temperature. It is necessary, therefore, to frequently replace the heating elements which takes time and shuts the furnace down during replacement. In addition, the molybdenum disilicide is extremely brittle and elements can easily be broken during the replacement process.

The prior art has suggested a mechanical press-fit connector for attaching a conductor to the heating element. It has been found that such a mechanical connection alone does not operate successfully and suffers from some of the same problems as the clamp-on connectors normally employed. Thus, there exists a need for a connecting system for providing a permanent mechanical and electrical connection of a conductor for supplying current to such heating elements which avoids the problems in the prior art structure.

SUMMARY OF THE INVENTION

The present invention has solved this problem by brazing a sleeve to the end of the cermet heating element with a portion of the sleeve extending beyond the end of the heating element to provide a receptacle for receiving and holding one end of a conductor employed for applying electrical current to the heating element. The process of brazing the sleeve to the end of the rod includes the steps of fluxing the end of the heating element and the internal portion of the sleeve, joining the sleeve to the element while heating the two to brazing temperatures, applying the brazing alloy to the open end of the sleeve remote from the heating element while continuing to heat the junction such that the brazing alloy is drawn into and fills the area between the sleeve and heating element, and subsequently removing the excess flux and attaching the conductor to the open end of the sleeve projecting from the rod.

It has been found that this method and its resulting connector provides a permanent connection of the electrical conductor to cermet heating elements such as molybdenum disilicide heating elements and overcomes the problems of mechanical connections by the bonding of the connector to the heating element. As a result, the heating elements can be use in combustion furnaces at extremely high temperatures without oxidizing the connection of the conductors to the heating elements and the problems resulting therefrom.

These and other features, advantages, and objects of the present invention can best be understood by reference to the following description thereof, together with the accompanying drawings, in which:

DETAILED DESCRIPTION OF THE PREFERRED EMBODIMENT

Figure 1:
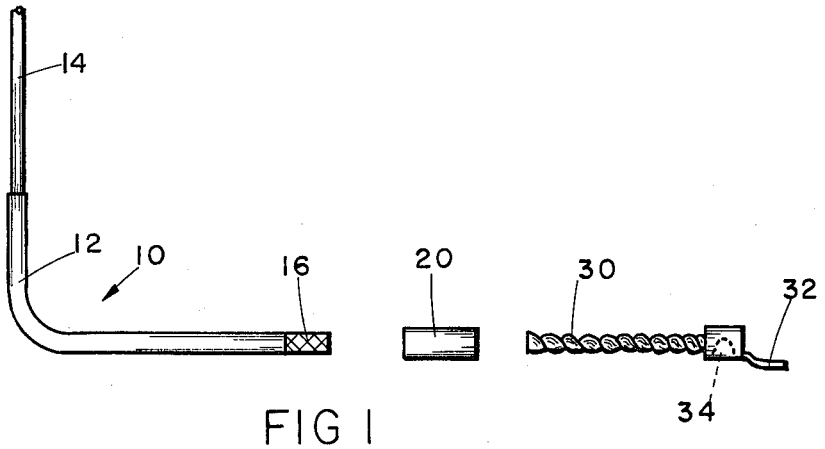
FIG. 1 is a fragmentary side elevational view in exploded form of the elements joined according to the present invention.

Referring initially to FIG. 1, there is shown one leg of a generally U-shaped cermet heating element having an enlarged L-shaped lower leg 12 coupled to a reduced diameter heating element 14 which extends in a generally U-shaped configuration and teminates in another L-shaped leg (not shown) parallel to leg 12. The end 16 of leg 12 is coated for a distance of approximately ½ inch with aluminum. The heating element in the preferred embodiment was a super KANTHAL® number 33 and is one of the several elements used in the resistance furnace of the combustion system disclosed in the above identified copending application, the disclosure of which is incorporated herein by reference.

The leg 12 of heating element 10 is generally rod-shaped having a diameter of slightly less than ¼ inch. A copper cylindrical sleeve 20 having an internal diameter of ¼ inch, an external diameter of 5/16 inch, and a length of approximately 1 inch is employed according to the present invention for connecting a No. 6 gauge stranded copper conductor 30 to the heating element 10. A connector lug 32 is crimped to the end of conductor 30 remote from sleeve 20. Lug 32 is secured to the copper wire by means of staking as indicated by the deformed segment 34. In order to provide both a mechanical and a permanent electrical connection of the conductor 30 to end 16 of the heating element, sleeve 20 is bonded to the heating element by a brazing process now described in connection with FIG. 2.

The first step in the process is indicated by block 40 in FIG. 2 and comprises the removal of the aluminized ends 16 of the heating element 10 by immersing the ends in a saturated solution of sodium hydroxide at room temperature for approximately 30 minutes and subsequently rinsing the ends in water as indicated by step 42.

After the etched and rinsed ends of the heating element have dried, the element is clamped in a generally horizontally extending position with the ends 16 tilted upwardly slightly, however, (10°–15°) to promote the flow of brazing alloy down the sleeve 20. A flux is then applied as indicated by block 44 to the ends of the heating element as well as to the internal and external surfaces of sleeve 20. The flux employed in the preferred method is Harris black flux formula with a use temperature of 700° to 2200° F. The copper sleeve 20 is then slid onto the end of the heating element about halfway such that the end of the heating element 16 extends approximately to the longitudinal middle of sleeve 20 as indicated by block 46. Thus, the end of sleeve 20 comprising the copper tubing remote from the heating element has a ½ inch cylindrical receptacle for subsequently receiving the end of wire 30. An annular gap or clearance space of about 1/64 inch exists between the outer surface of element 10 and the inner surface of sleeve 20. Next, the junction of the sleeve 20 with end 16 of the heating element is heated using an oxyacetylene torch adjusted for a carburizing (i.e., low temperature) flame. This is achieved by providing excess acetylene-to-oxygen mixture providing a lower temperature flame which has a reddish characteristic as is well known in the brazing art. Heat is applied to the end of leg 12 near the sleeve 20 and directly on the sleeve using a short oscillatory motion of the torch heating the junction of the parts as uniformly as possible. Due to the relative mass between the elements, however, it is necessary to concentrate more of the heat on the end of the heating element than on the sleeve. This is represented by step 48 in FIG. 2.

Figure 3:
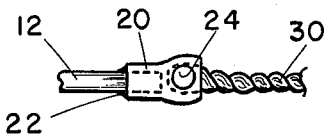
FIG. 3 is a fragmentary plan view of the resultant electrical connection of a conductor to a cermet heating element.

Next, with the joint heated and maintained at a temperature within the flowpoint of the brazing alloy and in excess of about 1145° F. and within a range of about 1145° to 1400° F. a wire-shaped brazing alloy such as Sil-Bon 45 is first dipped into the flux and then applied to the junction of sleeve 20 and end 16 of the heating element through the open right end (as viewed in FIG. 1) of the sleeve. Heat is continuously applied to the end of heating element 12 adjacent the left end of sleeve 20 to draw the brazing alloy within the tube such that the brazing alloy will surround the annular space between the external diameter of heating rod 12 and the internal cylindrical surface of sleeve 20. The supplyng of the brazing alloy to the open end of sleeve 20 in the enclosed and nonoxidizing environment of the sleeve is believed to result in the successful bonding of sleeve 20 to the heating element. The brazing alloy is permitted to flow until a fillet 22 of brazing alloy extends outwardly from the left end of sleeve 20 as seen in FIG. 3. This step is indicated in block 50 in FIG. 2. Once the brazing alloy is seen filling the left junction of sleeve 20 and the element 12, the heat is removed from the junction and the brazing alloy is allowed to cool and solidify, thus bonding the sleeve 20 to the leg 12 of the heating element.

Figure 2:
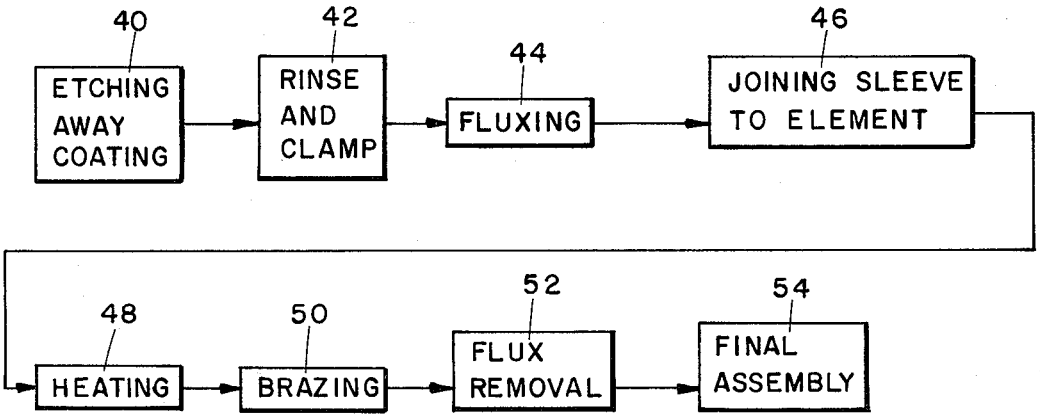
FIG. 2 is a flow diagram in block form showing the method by which the structural elements shown in FIG. 1 are assembled.

Next, as indicated by block 52 in FIG. 2, the flux is removed by immersing the sleeve and end of the heating element in a solution of commercially available flux removal compound sold under the trademark Exflux comprising a solution of 1 pound of compound dissolved in 1 gallon of water. The solution is mixed in a nonmetallic container and stirred with a wooden paddle and heated to above 180° F. before immersing the heating element which is placed in the solution for approximately 1 to 2 minutes until the flux residue is dissolved. The heating element with the bonded sleeve 20 is then rinsed with clear water and dried. Next, the final assembly is accomplished as indicated by block 54 in FIG. 2, by crimping the free end of conductor 30 within the open end of sleeve 20. This is achieved by positioning the end of conductor 30 within the sleeve and crimping it with a conventional crimping tool to deflect the copper into compressive engagement with the conductor as shown by depression 24 in FIG. 3. Naturally, although only one of the legs of the heating element of the preferred embodiment has been shown and described, the fluxing, joining, heating, brazing, and flux removal steps are performed simultaneously for both legs of the U-shaped heating element.

The resultant permanent electrical and mechanical connection as shown in FIG. 3 with the bonded sleeve, provides excellent electrical and mechanical characteristics for providing operating power to the heating element which is achieved by connecting lug 32 to an electrical power supply remote from the area of concentrated heat at end 16 of the rod. The heating element with such improved connection can tolerate temperatures well in excess of 900° F. and provides a durable and electrically reliable method and apparatus for coupling the electrical conductor from a power supply to cermet resistance heating elements.

It will become apparent to those skilled in the art that various modifications to the preferred embodiment of the invention can be made. Thus, for example, the teachings of this invention can be used with other cermet heating elements, the sleeve 20 employed may not be cylindrical but can assume any shape which corresponds to the shape of the heating element and which is of a material to which a brazing compound will bond. These and other modifications to the preferred embodiment, however, will fall within the spirit and scope of the invention as defined by the appended claims.

The embodiments of the invention in which an exclusive property or privilege is claimed are defined as follows:

1. A connector assembly for use with a cermet heating element comprising:

a cermet heating element for a furnace having an end with a diameter of about ¼ inch for receiving an electrical conductor for applying electrical operating power to said heating element; and a metallic electrically conductive sleeve having one end positioned over and surrounding said end of said heating element and bonded thereto by a brazing alloy and having an opposite open end defining a cavity for receiving the end of an electrical conductor.

2. The assembly as defined in claim 1 wherein said sleeve is a deformable tube and further including a conductor having one end crimped into position within said cavity of said sleeve.

3. The assembly as defined in claim 2 wherein said heating element is made of molybdenum disilicide and said sleeve is made of copper.

4. The assembly as defined in any of claims 1 through 3 wherein said end of said heating element has a round cross section and wherein said sleeve is cylindrical having an internal diameter to provide a slight clearance between said sleeve and said heating element which clearance is filled with said brazing alloy.

5. A method of electrically and mechanically bonding a metalllic sleeve to the end of a cermet heating element which has an aluminum coating comprising the steps of:

removing the aluminum coating from the end of the heating element;

fluxing the mating surfaces of the heating element and sleeve;

positioning one end of the sleeve over the end of the heating element having a diameter of about 174 of an inch with the opposite end of the sleeve projecting outwardly from said end of said heating element;

heating said end of said heating element and said sleeve to temperatures at least equal to the flow point of a brazing alloy;

applying a brazing alloy to the junction of the sleeve and heating element through said open opposite end of said sleeve to fill the space between said sleeve and heating element; and cooling said heating element and sleeve to bond said heating element and sleeve.

6. The process as defined in claim 5 wherein said heating step is performed using an oxyacetylene torch adjusted for a carburizing flame.

7. The process as defined in claim 6 wherein said positioning and heating and cooling steps are completed while holding said heating element and said sleeve in a position with the opposite end of said sleeve slightly elevated to promote the flow of brazing alloy into the space between said heating element and sleeve.

8. The process as defined in claim 7 and further including the step of removing flux from the sleeve and heating element subsequent to the cooling step.

9. The process as defined in claim 8 and further including the step of crimping one end of a conductor within the opposite end of said sleeve.

* * * * *

UNITED STATES PATENT AND TRADEMARK OFFICE

CERTIFICATE OF CORRECTION

PATENT NO. : 4,275,375

DATED : June 23, 1981

INVENTOR(S) : Charles B. Vallance

It is certified that error appears in the above—identified patent and that said Letters Patent is hereby corrected as shown below:

Column 5, line 2:
"174" should be --1/4--

Signed and Sealed this

*Twenth-eighth* Day of *September 1982*

[SEAL]

*Attest:*

GERALD J. MOSSINGHOFF

*Attesting Officer*

*Commissioner of Patents and Trademarks*